US006691348B2

(12) United States Patent
Plummer et al.

(10) Patent No.: US 6,691,348 B2
(45) Date of Patent: Feb. 17, 2004

(54) BED WITH ADJUSTABLE POSITIONS

(76) Inventors: Stephen B. Plummer, 2853 Upland Cr., Vancouver, B.C. (CA), V2T 2G1; Mike Jillings, 46159 Riverside Drive, Chilliwack, B.C. (CA), V2P 3L1; J. Anthony Penny, 104-1972 Robson St., Vancouver (CA), V6G 1E8

( * ) Notice: Subject to any disclaimer, the term of this patent is extended or adjusted under 35 U.S.C. 154(b) by 5 days.

(21) Appl. No.: 10/081,845

(22) Filed: Feb. 25, 2002

(65) Prior Publication Data

US 2002/0116764 A1 Aug. 29, 2002

(51) Int. Cl.[7] ..... A61G 7/008

(52) U.S. Cl. ..... 5/609; 5/615; 5/610; 5/611; 5/430

(58) Field of Search ..... 5/607, 608, 609, 5/610, 611, 615, 428, 430, 722, 740

(56) References Cited

U.S. PATENT DOCUMENTS

| | | | | | |
|---|---|---|---|---|---|
| 3,210,778 | A | * | 10/1965 | Robinson | 5/607 |
| 3,238,539 | A | * | 3/1966 | Koch | 5/607 |
| 3,606,623 | A | * | 9/1971 | Aymar | 5/660 |
| 4,084,274 | A | * | 4/1978 | Willis et al. | 5/609 |
| 4,527,298 | A | | 7/1985 | Moulton | |
| 4,658,450 | A | * | 4/1987 | Thompson | 5/607 |
| 4,839,932 | A | | 6/1989 | Williamson | |
| 4,873,731 | A | * | 10/1989 | Williamson | 5/615 |
| 4,941,221 | A | * | 7/1990 | Kanzler | 5/615 |
| 5,101,519 | A | | 4/1992 | Yamamoto | |
| 5,479,665 | A | * | 1/1996 | Cassidy et al. | 5/613 |
| 5,502,853 | A | * | 4/1996 | Singleton et al. | 5/609 |
| 5,506,012 | A | | 4/1996 | Wright et al. | |
| 5,613,252 | A | * | 3/1997 | Yu et al. | 5/88.1 |
| 5,625,913 | A | * | 5/1997 | Singleton | 5/609 |
| 6,385,801 | B1 | * | 5/2002 | Watanabe et al. | 5/607 |

* cited by examiner

*Primary Examiner*—Michael F. Trettel
(74) *Attorney, Agent, or Firm*—Frederick Kaufman Inc

(57) ABSTRACT

A bed with adjustable positions comprises head, foot and central units. The head and foot units include respectively an upper and lower structure and a linear actuator for elevating or lowering the upper structure with respect to the lower structure. Two opposite upper structures can be elevated simultaneously or separately. The central unit is provided with a central platen to which a pair of side platens is hinged. A rotation subassembly is located in head and foot units respectively and is intended to turn the central unit, while an inclination subassembly is used to incline the side platens, so as to prevent the patient from sliding during rotation. A pneumatic bag subassembly is formed from upper and lower sections, which can be independently inflated or deflated. A reaction board, having a width slightly narrower than central platen and a length substantially equal to the upper section, is placed on the latter. Central unit includes as well a pneumatic actuating subassembly for supplying air to the upper and lower sections. An articulated mattress, formed from a central segment to which two lateral segments are longitudinally hinged, is placed on upper and lower sections, the reaction board being interposed between the upper section and the mattress. A pair of side rail assemblies is used with the central unit. Each side rail assembly is attached to an exterior long margin of a side platen.

5 Claims, 16 Drawing Sheets

BED WITH ADJUSTABLE POSITIONS

BACKGROUND OF THE INVENTION

1. Field of the Invention

This invention relates to adjustable support systems and, more particularly, to a bed with adjustable positions.

2. Description of the Related Prior Art

In order to comply with continuing consumer demand, especially from persons lying in bed for a long period of time, for example bed-ridden patients, numerous structural configurations of beds have been developed.

For a bed-ridden patient who is physically, unable to move by himself, one of the problems, which he/she suffers from, is bedsores, since he/she cannot change his/her position.

Attempts have been made in the past to develop a better multipositional bed. Several U.S. Patents have addressed this issue. For example U.S. Pat. No. 6,112,349 dated Sep. 5, 2000 and granted to Connolly for a "Therapeutic device" describes a therapeutic bed including a castor support framework and a Trendellenburg support frame including curved arms which are mounted on guide rollers of the castor frame. The Trendellenburg support carries guide rollers on which rings at opposite ends of the bed run. A patient support platform is mounted on the rings. A patient supine support including a mattress and leg supports are mounted on the patient support platform. Side rails are engageable and lockable to the platform. A patient prone support includes a head support, an adjustable abdomen support and support pad sections which are each split longitudinally to define adjustable support pads which are hingedly mounted to the corresponding opposite side rails, engaged and locked in position. In its bed configuration, Connolly's structure has a number of shortcomings. First, the height of the bed cannot be adjusted to a convenient operational level for caregivers of different heights. Second, no means is provided to keep the side rails in a vertical position, regardless of the degree of rotation of the bed and its associated mattress. Third, the rotation mechanism is cumbersome. Fourth, use is made of straps and pads to keep the patient from moving while the bed is rotated. U.S. Pat. No. 6,038,717 dated Mar. 21, 2000 and granted to Persson for a "Device for a bed" describes a bed wherein the bottom is arranged to be shifted between a horizontal position and two laterally pivoted positions. The bed comprises a plurality of abutment members disposed in the area of the longitudinal sides of the bed and has an elongated body provided with projecting members having a configuration complimentary to that of the abutment members. The projecting members and the abutment members extend essentially in the transverse direction of the bed. The device also comprises a drive mechanism that produces a relative movement between the projecting members and the abutment members for the purpose of producing a lateral contact area and the bed bottom movements. There are several disadvantages to this bed. First, the manufacturing of projecting and abutment members is believed to be difficult and expensive. Second, the use of a one-piece mattress does not provide the necessary flexibility needed to adjust to the different positions of the bed and, impliedly, does not provide comfort for the user. Third, the bed is not provided with means for elevating the head or feet of the user. U.S. Pat. No. 5,625,913 dated May 6, 1997 and granted to Singleton for an "Oscillatory bed" describes a bed having a removable cradle assembly received on top of a bed frame assembly. The cradle assembly may be oscillated by a microprocessor controlled electrical motor or oscillated manually. The cradle assembly includes a cradle base attached at opposite ends to a semi-circular footboard and semi-circular headboard. The bed frame assembly includes a pair of parallel longitudinal support members attached at opposite ends to a footboard support member and a headboard support member. The footboard and headboard support members include roller bearings mounted inside thereof for receiving the semicircular footboard and headboard thereon. In the motorized version of the bed, the footboard support member includes a gear motor mounted within that engages a gear toothed or rubber friction equipped roller. This bed has several drawbacks. First, the rotating mechanism is cumbersome. Second, the height of the bed cannot be adjusted to a convenient operational level for caregivers of different heights. Third, no means is provided to keep the side rails in a vertical position, regardless of the degree of rotation of the bed and its associated mattress. U.S. Pat. No. 5,515,561 dated May 14, 1996 and granted to Suggit et al. for an "Articulating bed" describes a bed having a central platen disposed between two side platens. A headboard and a footboard are used respectively at each longitudinal end of the platens. This patent which has the same applicant as the present invention has several shortcomings. First, no mechanism for elevating or lowering the bed is provided. Second, no side rails are provided. Third, no mechanism for raising or lowering the head and/or feet is incorporated.

SUMMARY OF THE INVENTION

The purpose of the present invention is to alleviate the drawbacks and difficulties shown in the prior art.

Therefore, it is a principal objective of the present invention to provide a multipositional, universally adjustable, self-contained, completely integrated and well engineered bed to enable a multipurpose use with both convenience and comfort.

In general, the bed with adjustable positions in accordance with the present invention comprises a head unit;

a foot unit; and a central unit supported at one end by the head unit and at the other end by the foot unit.

The head unit includes a lower structure and an upper structure;

means for vertically guided sliding of the upper structure with respect to the lower structure, the means for vertically guided sliding being attached to the upper and lower structures;

first linear type actuating means for elevating or lowering the upper structure with respect to the lower structure. The first linear type actuating means is attached to the upper and lower structures.

Use is made of means for rotating the central unit. This means for rotating the central unit incorporates a rocker plate disposed and able to pivot in an interior of the upper structure; and second linear type actuating means for pivoting the rocker plate with respect to the upper structure;

a double-flanged adapter attached to a side of the rocker plate which is directed toward the central unit.

A pair of inclination subassemblies is used during the rotation of the bed. This pair of inclination subassemblies includes a link connected at its lower end to a lower beam of the upper structure by a pin which extends toward the central unit; and an attachment bracket connected to an upper end of the link. Due to the pin, which extends beyond the upper structure, the link can be moved in a vertical plane, which is parallel and outside of the upper structure.

The foot unit comprises essentially the same structure as the head unit. The central unit includes a central platen to which a pair of side platens is hinged;

means for connecting transversal margins of the central platen to the rocker plate;

means for connecting short margins of each side platens to the attachment brackets.

Use is made as well of a pneumatic bag subassembly, which comprises an upper section and a lower section; each of the upper and lower sections being independently inflatable; the upper and lower sections are slightly narrower than a combined width of the central and side platens;

a reaction board disposed on the upper section and having a width slightly narrower than the central platen and a length substantially equal to the upper section; the reaction board having an edge hinged to a center of the central platen.

The bed comprises as well a pneumatic actuating subassembly secured beneath the central platen.

The pneumatic actuating subassembly comprises an air blower connected to a feed valve connected at the air blower;

a first valve actuator connected at each end of the feed valve; one of the first valve actuator opens an air supply to the upper section, another first valve actuator opens an air supply to the lower section;

a pair of dump valves; one dump valve for the upper section, another dump valve for the lower section of the pneumatic bag subassembly; and a pair of second valve actuators for the pair of dump valve.

In the structure of the bed is also provided an articulated mattress which is placed on the pneumatic bag subassembly. The articulated mattress includes a central segment having a pair of longitudinal sides, to each of which is attached a lateral segment; and a pair of side rail assemblies, each of which being pivotally mounted to one of the exterior long margin of the side platen.

In one aspect of this invention a pair of side rail assemblies, adaptable for use with a bed with adjustable positions, is used. The bed comprises head, foot and central units, the latter being supported at one end by the head unit and at the other end by the foot unit, means for rotating the central unit, a pair of inclination subassemblies, used during the rotation of the bed, a pneumatic bag subassembly disposed on central and side platen of the central unit, a pneumatic actuating subassembly secured beneath the central platen and an articulated mattress placed on the pneumatic-bag subassembly. The pair of side rail assemblies comprises a pair of frames, each of the frames being attached to an exterior long margin of the side platen.

In another aspect of this invention, each of the frames includes an upper tube;

a lower tube;

several vertical tubes firmly connecting the upper and lower tubes;

an arm having one end attached to an extremity of the lower tube and another end attached to a pin;

a bearing block mounted with a close running fit on the pin and firmly attached to an exterior long margin of the side platen; and a latch pin block comprising a spring loaded pin for vertical translation in a slot of a footboard or a head board of the bed with adjustable positions.

In yet another aspect of the invention, a pneumatic bag subassembly adaptable for use with a bed with adjustable positions is defined. The pneumatic bag assembly includes upper and lower sections, placed on central and side platens; the upper and lower sections are slightly narrower than a combined width of the central and side platens, each of said sections being independently inflatable.

The upper section incorporates at least two superposed, interconnected bags. The lower section comprises a single compartment bag.

The upper and lower sections are each provided with a fitting passing through the central platen.

A reaction board is also included in the pneumatic bag subassembly and it has a width slightly narrower than the central platen and a length substantially equal to the upper section. The reaction board is placed on the upper section and has an edge substantially close and hinged to a center of the central platen.

In another aspect of the invention, head means adaptable for use with a bed with adjustable positions is used. The head means comprises an upper structure located above a lower structure;

said upper structure incorporating essentially a rectangular frame;

said lower structure having an elongated form;

a rod-guide step fastened to the lower structure and extending laterally and outwardly;

an intermediary structure centrally and laterally positioned with respect to the upper structure, to which it is rigidly secured;

a pair of guide sleeves attached to the upper and intermediary structures;

a pair of guide rods attached to the rod-guide step and extending upwardly; and linear type actuating means for elevating and lowering the upper structure.

The actuating means for elevating and lowering the upper structure being interposed between the intermediary structure and the rod-guide step causes a sliding of the pair of guide sleeves on the pair of rods.

BRIEF DESCRIPTION OF THE DRAWINGS

Although the characteristic features of this invention will be particularly pointed out in the claims, the invention itself and the manner in which it may be made and used, may be better understood by referring to the following description, taken in connection with the accompanying drawings forming part thereof, wherein like reference numerals refer to like parts throughout several views, in which:

DESCRIPTION OF THE PREFERRED EMBODIMENTS

Figure 1:
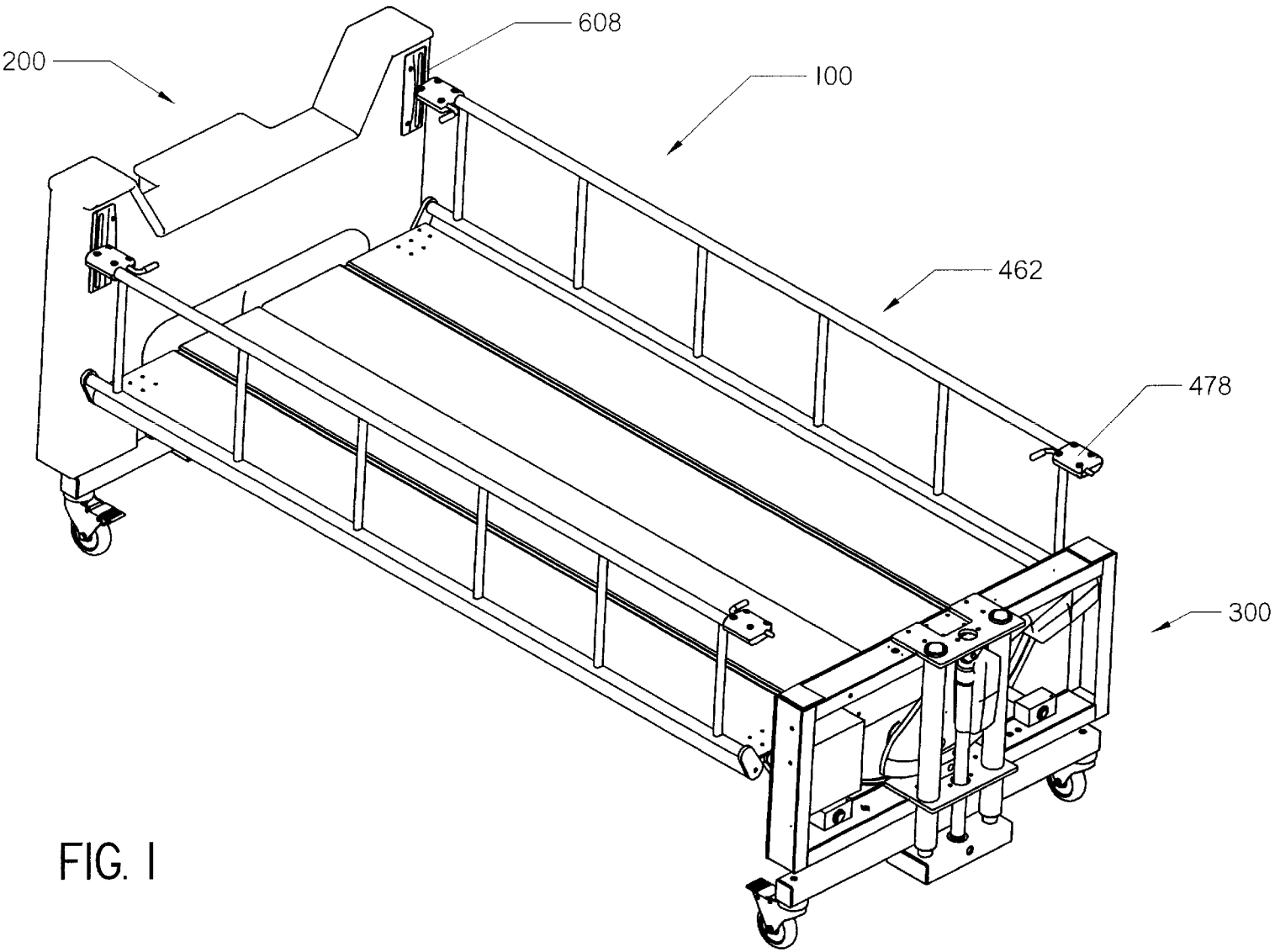
FIG. 1 is a perspective view illustrating the bed with adjustable positions according to principles of the present invention (without footboard and pneumatic bag subassembly)
Figure 2:
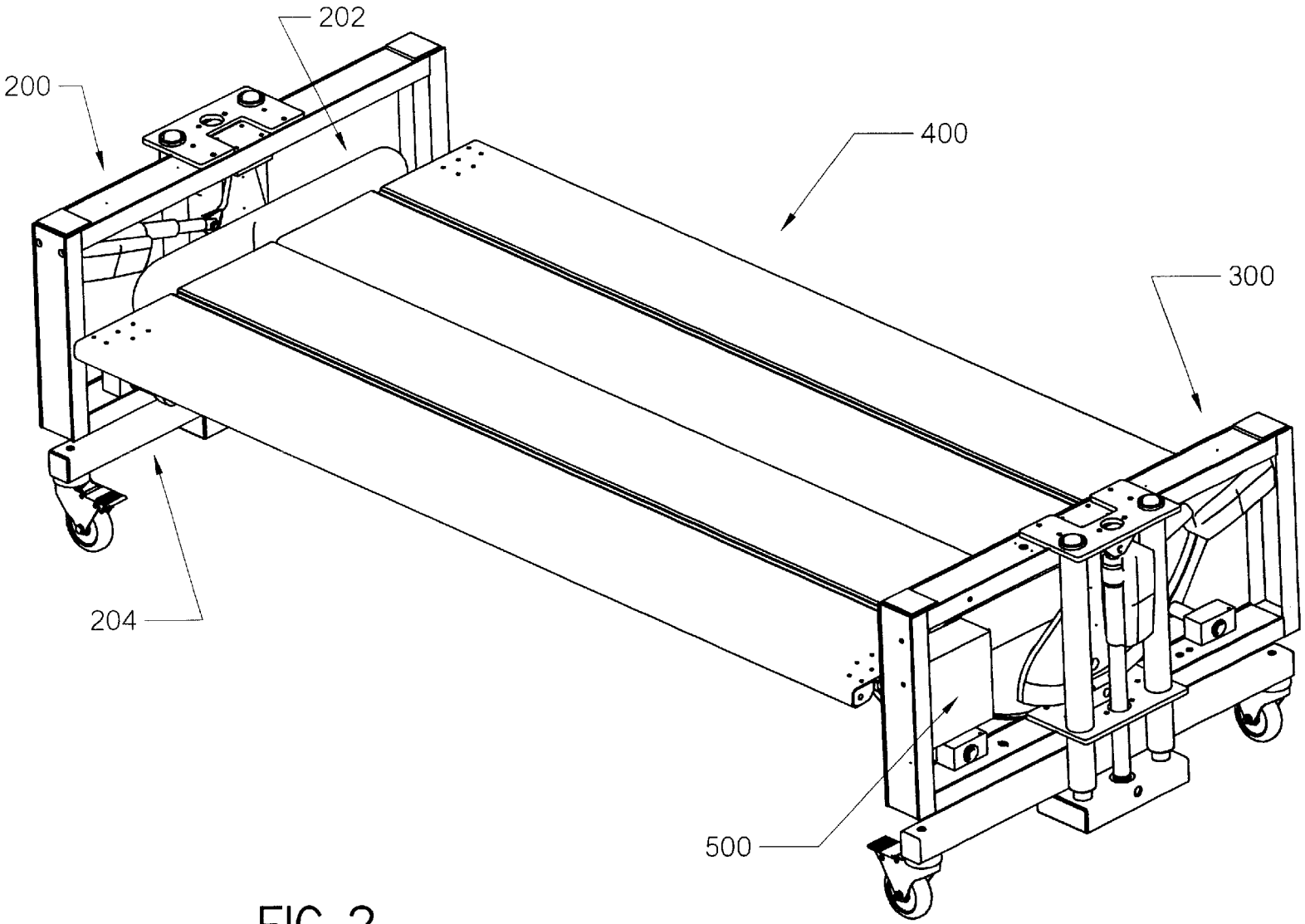
FIG. 2 is a perspective view illustrating the bed of the present invention without: footboard, headboard, side rails and pneumatic bag subassembly.
Figure 3:
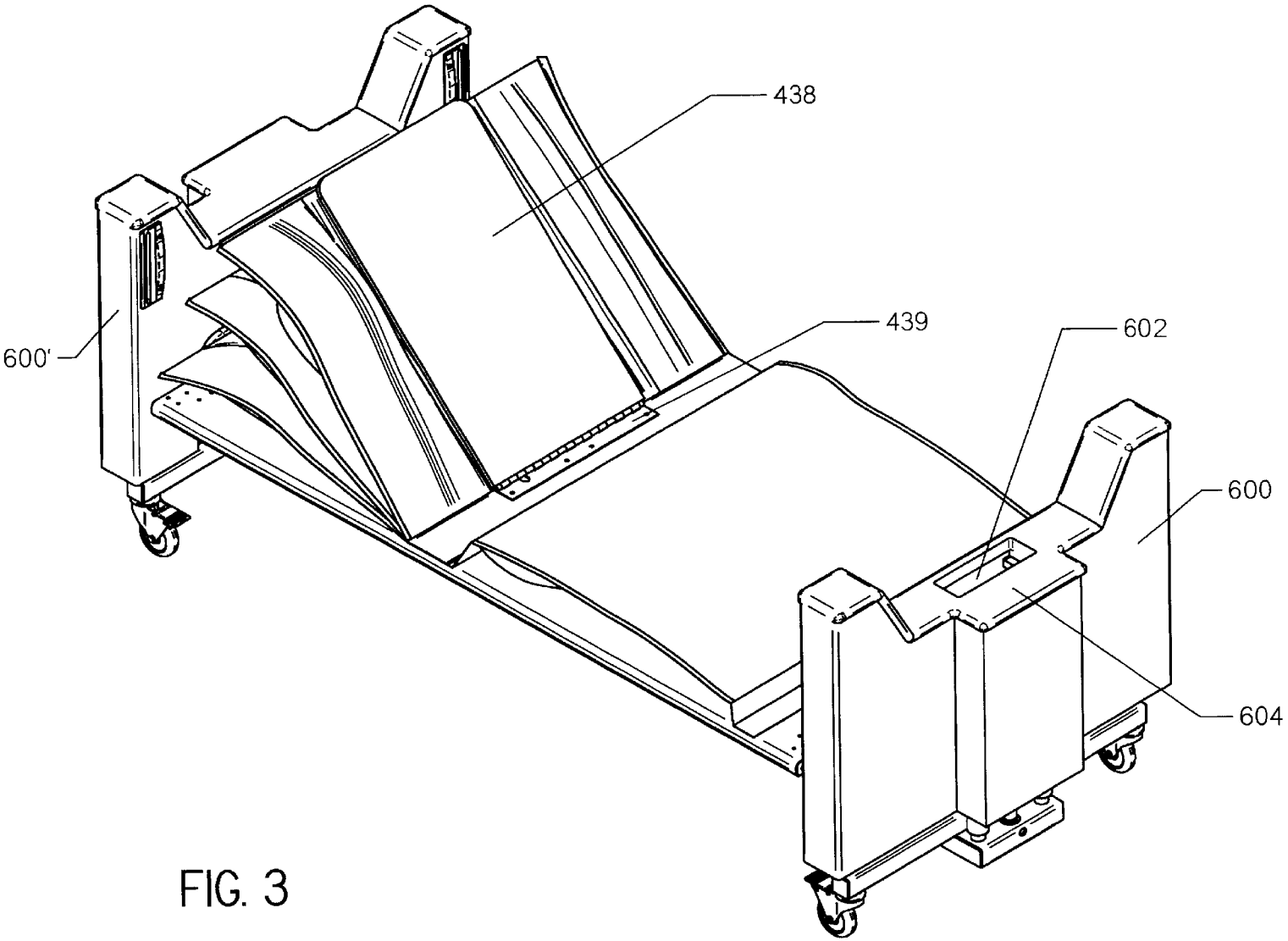
FIG. 3 is a perspective view illustrating the bed of the present invention without the pair of side rail assemblies.
Figure 4:
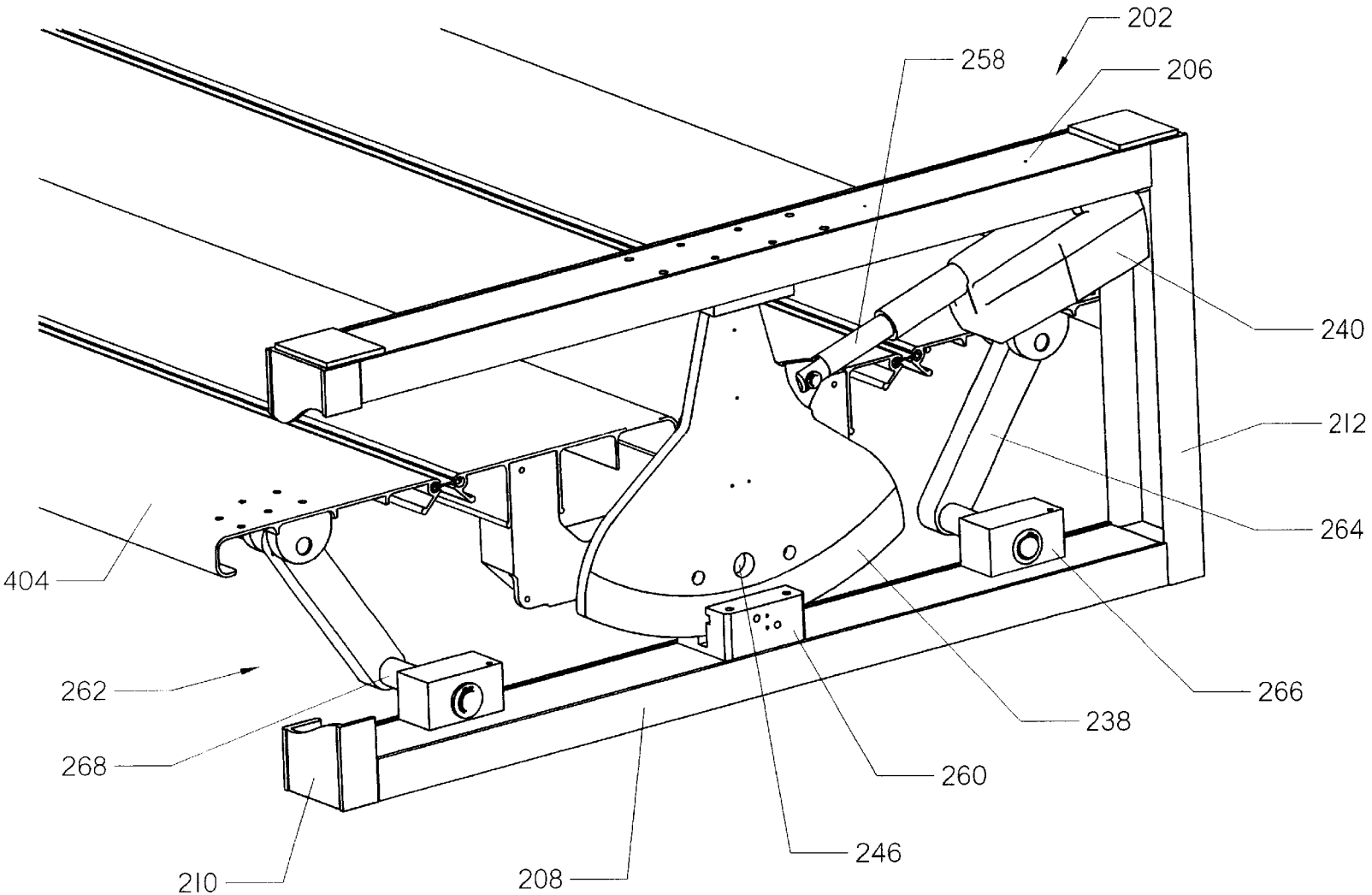
FIG. 4 is a perspective view of the upper structure of the head unit, which includes the rotation subassembly.
Figure 6:
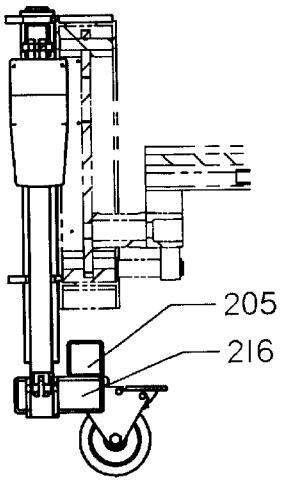
FIG. 6 is a right side view of the lower structure of the head unit together with the intermediary structure of the upper structure.
Figure 5:
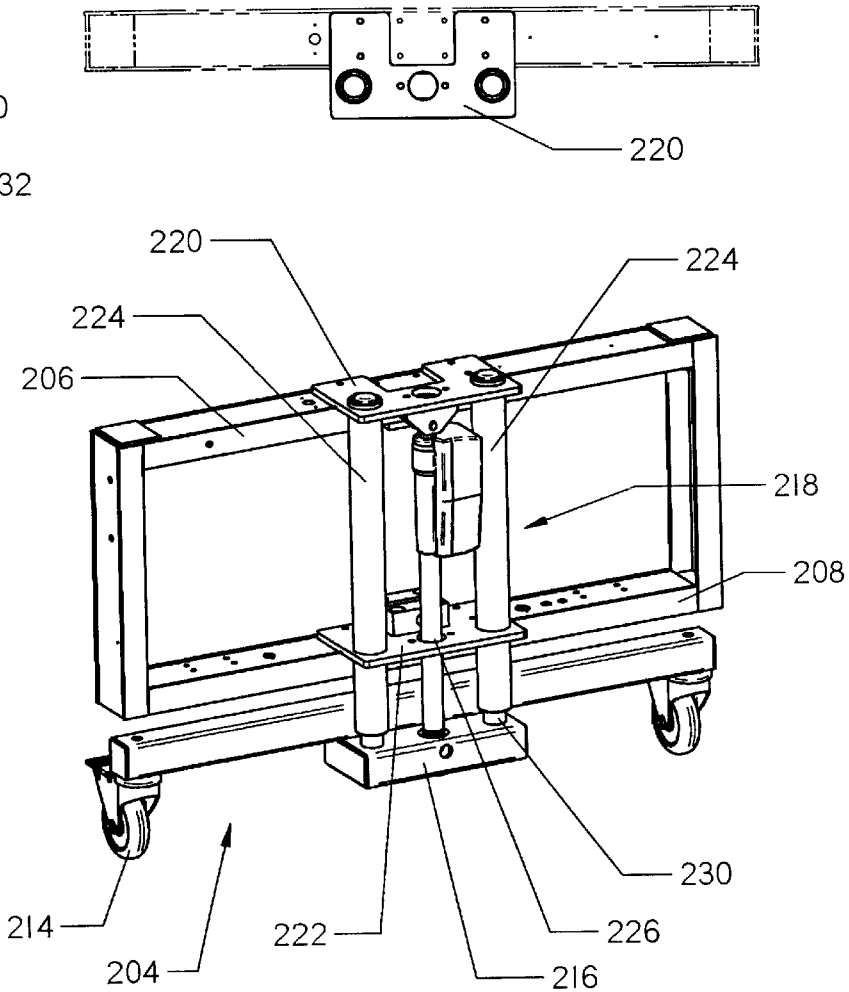
FIG. 5 is a front elevation of the lower structure of the head unit together with the intermediary structure of the upper structure.
Figure 7:
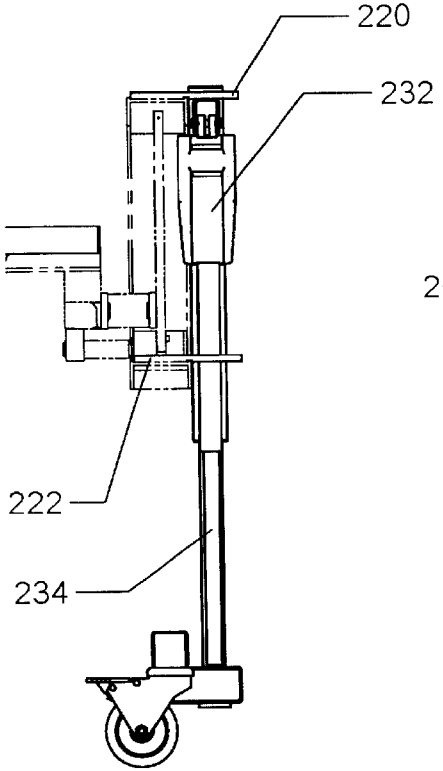
FIG. 7 is a left side view of the lower structure of the head unit together with the intermediary structure of the upper structure.
Figure 8:
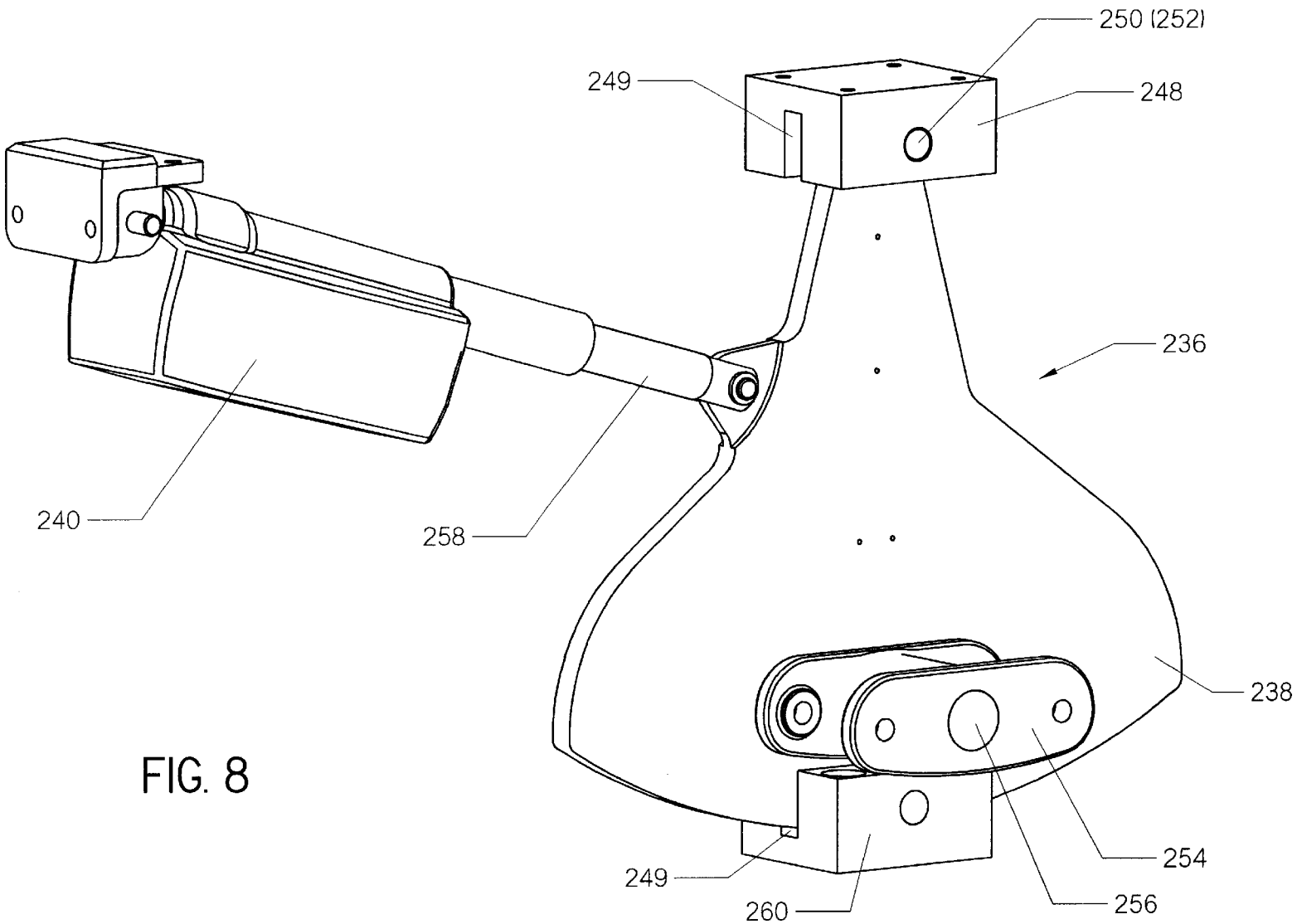
FIG. 8 is a perspective view of the rotation subassembly.
Figure 9:
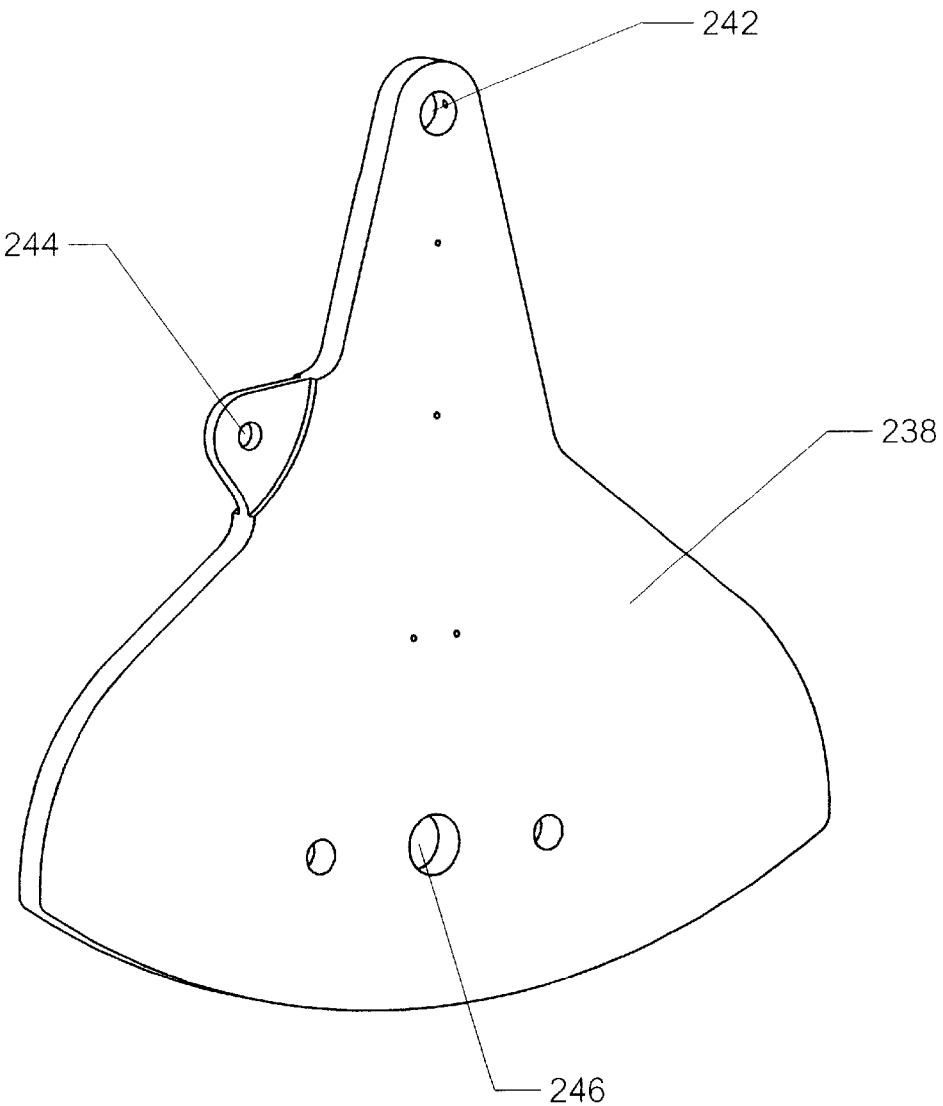
FIG. 9 is a perspective view of the rocker plate.
Figure 10:
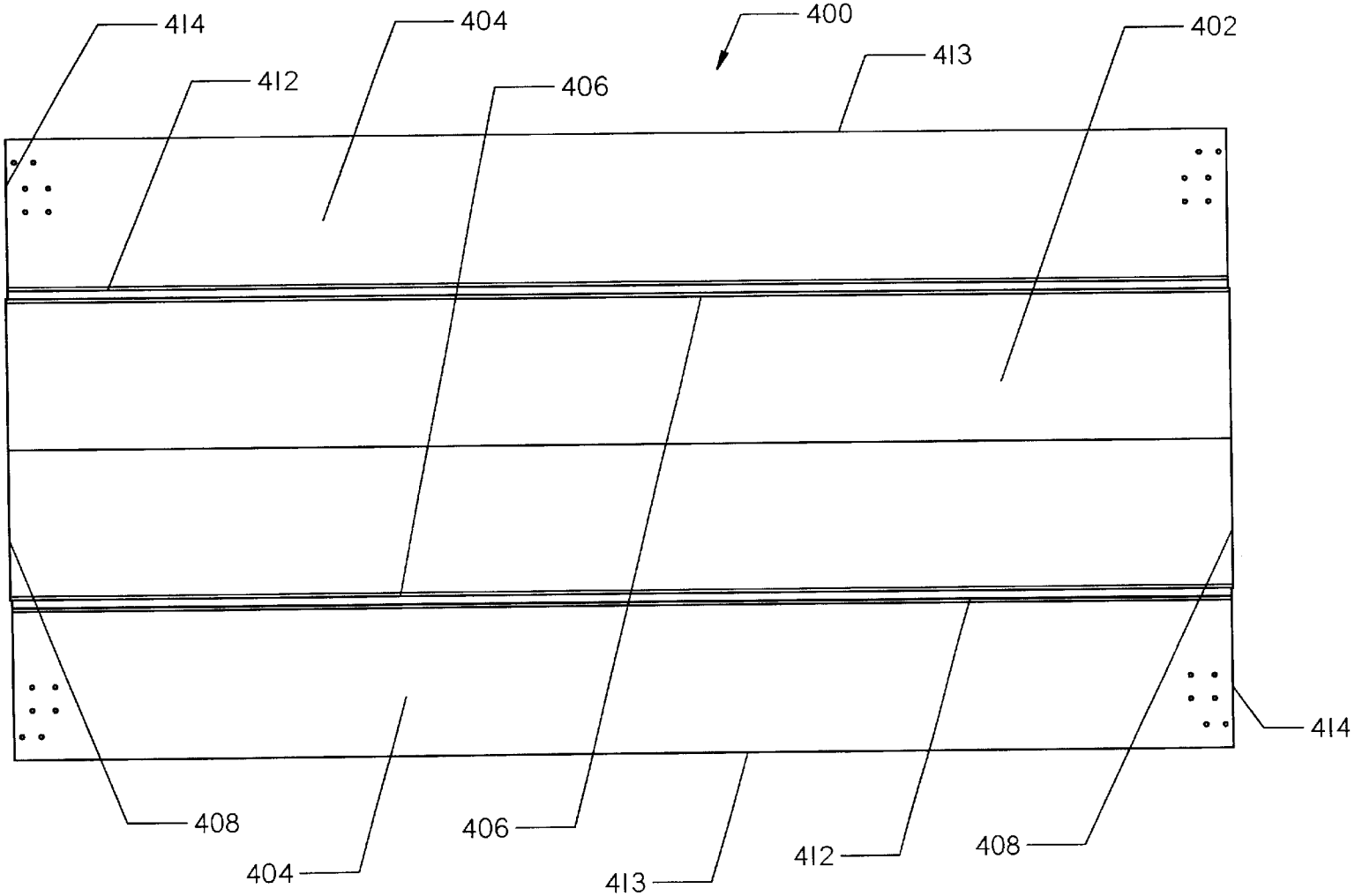
FIG. 10 is a top view of the central unit.
Figure 11:
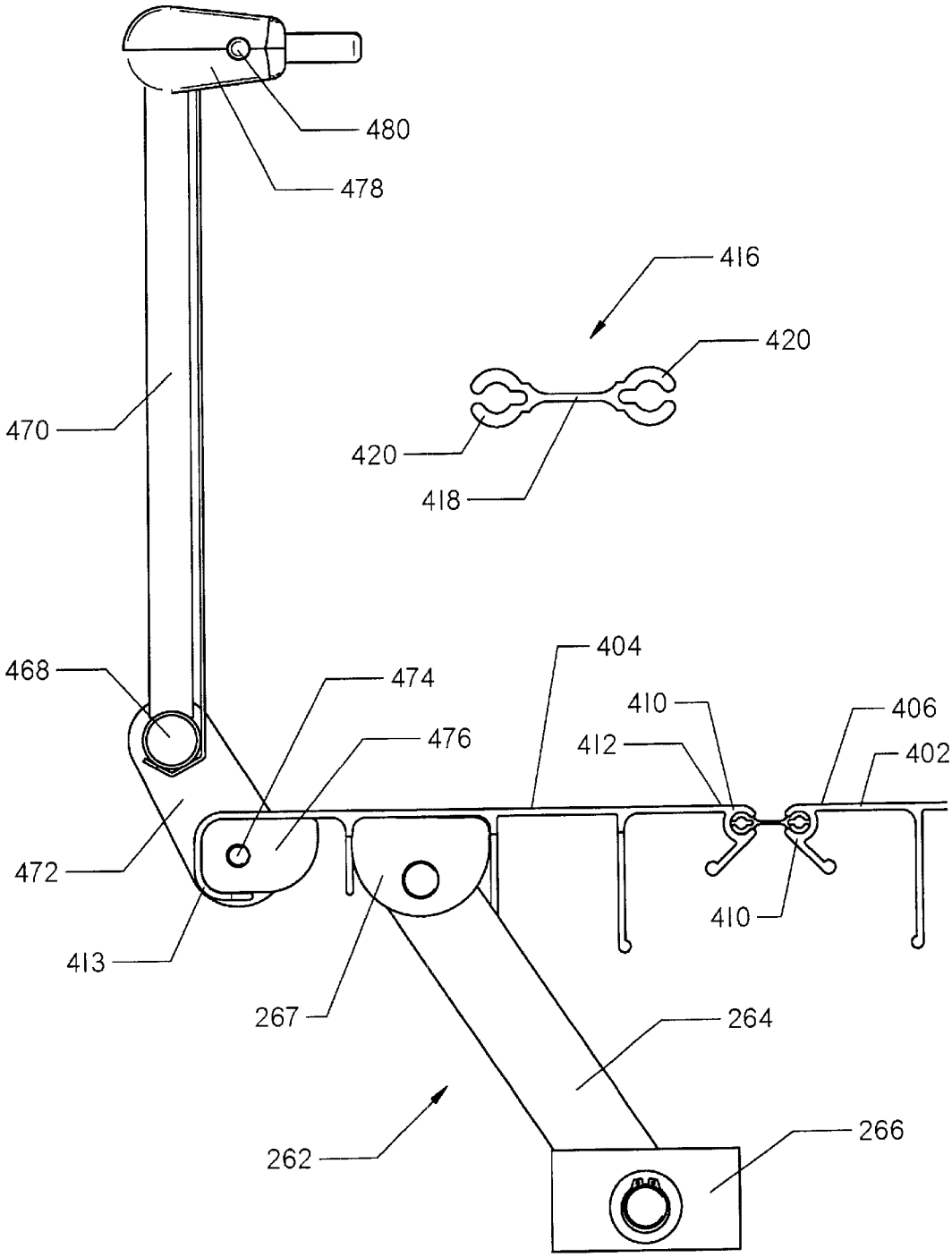
FIG. 11 is a front elevation of an inclination subassembly connected to a side platen to which is attached a side rail subassembly.
Figure 12:
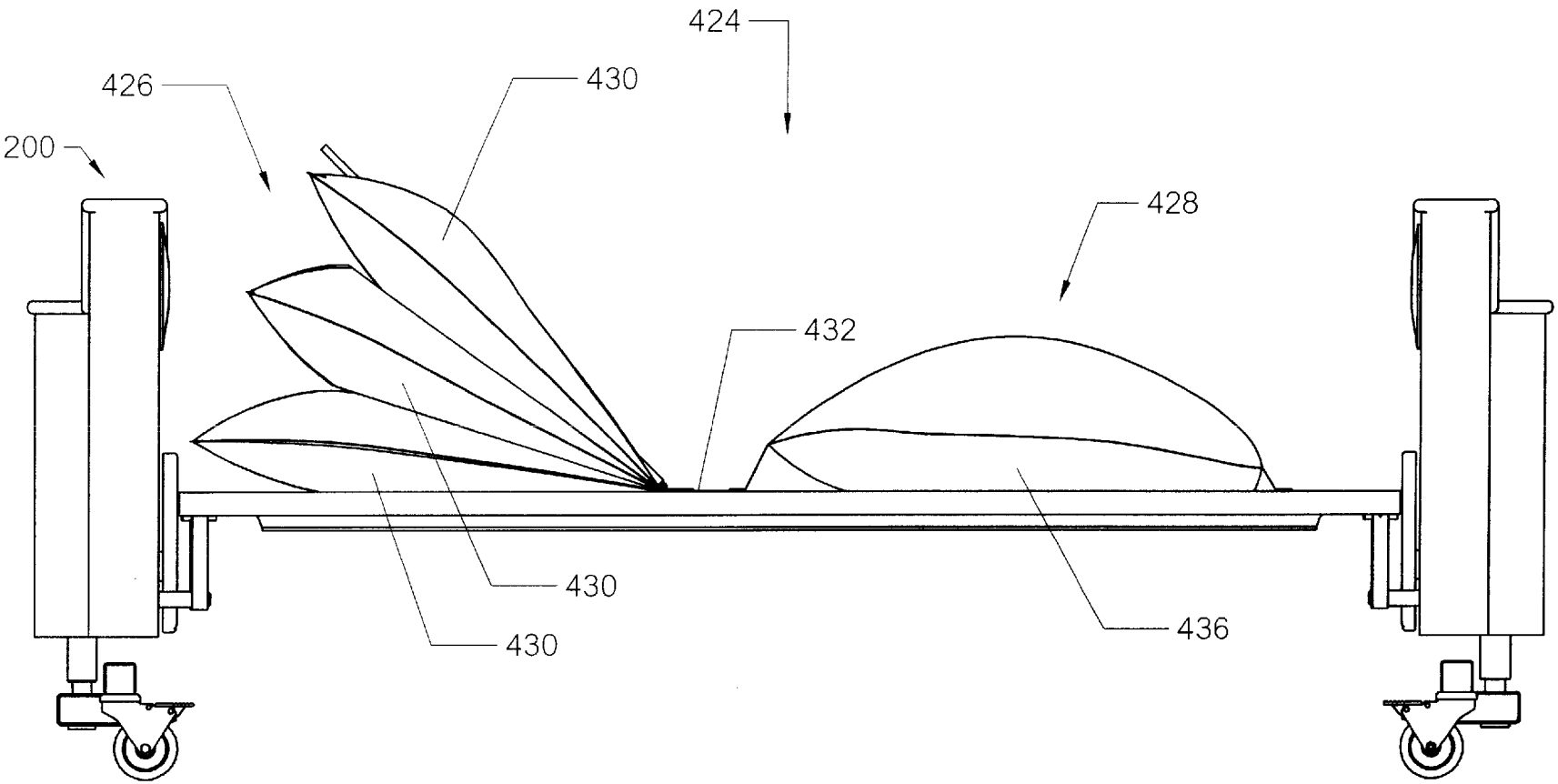
FIG. 12 is a front elevation view of the pneumatic bag subassembly mounted on the bed.
Figure 13:
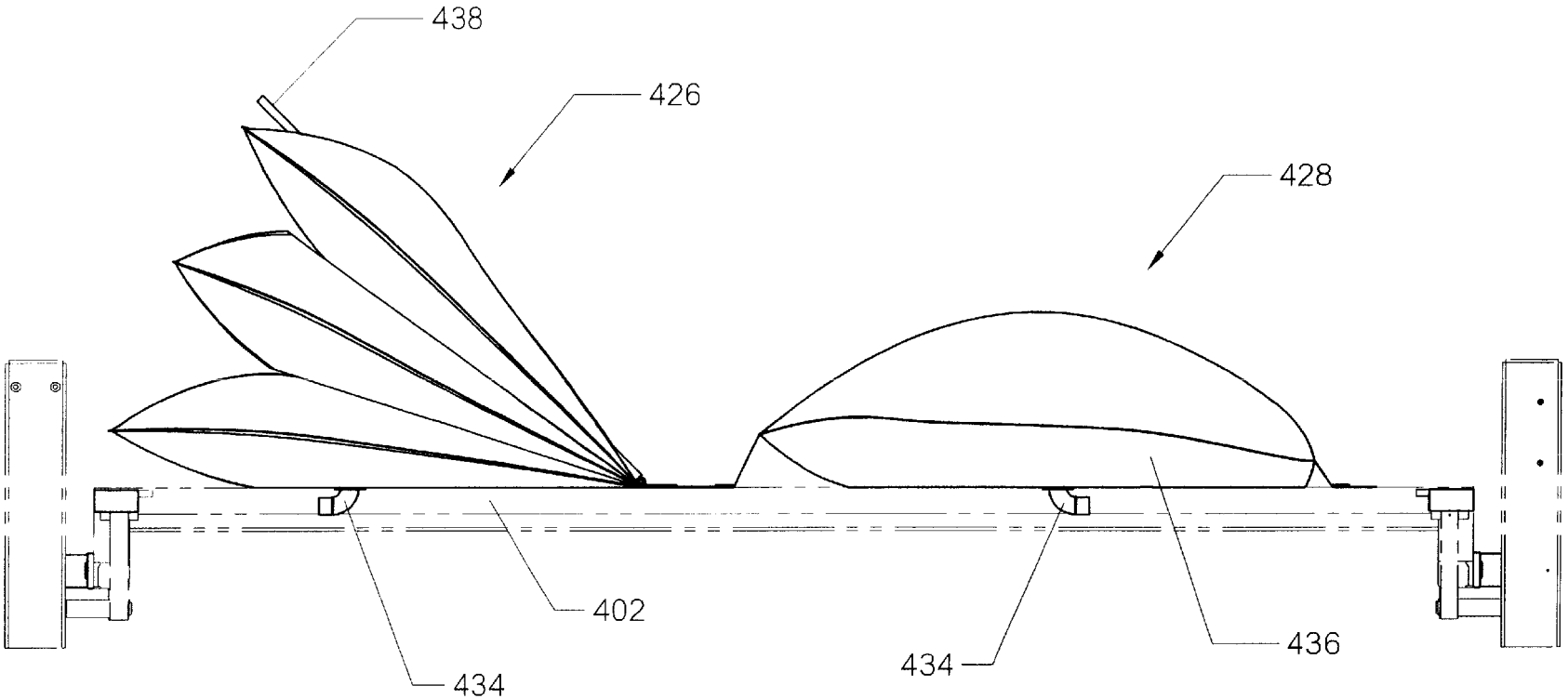
FIG. 13 is the front elevation of the pneumatic bag subassembly showing the fittings.
Figure 14:
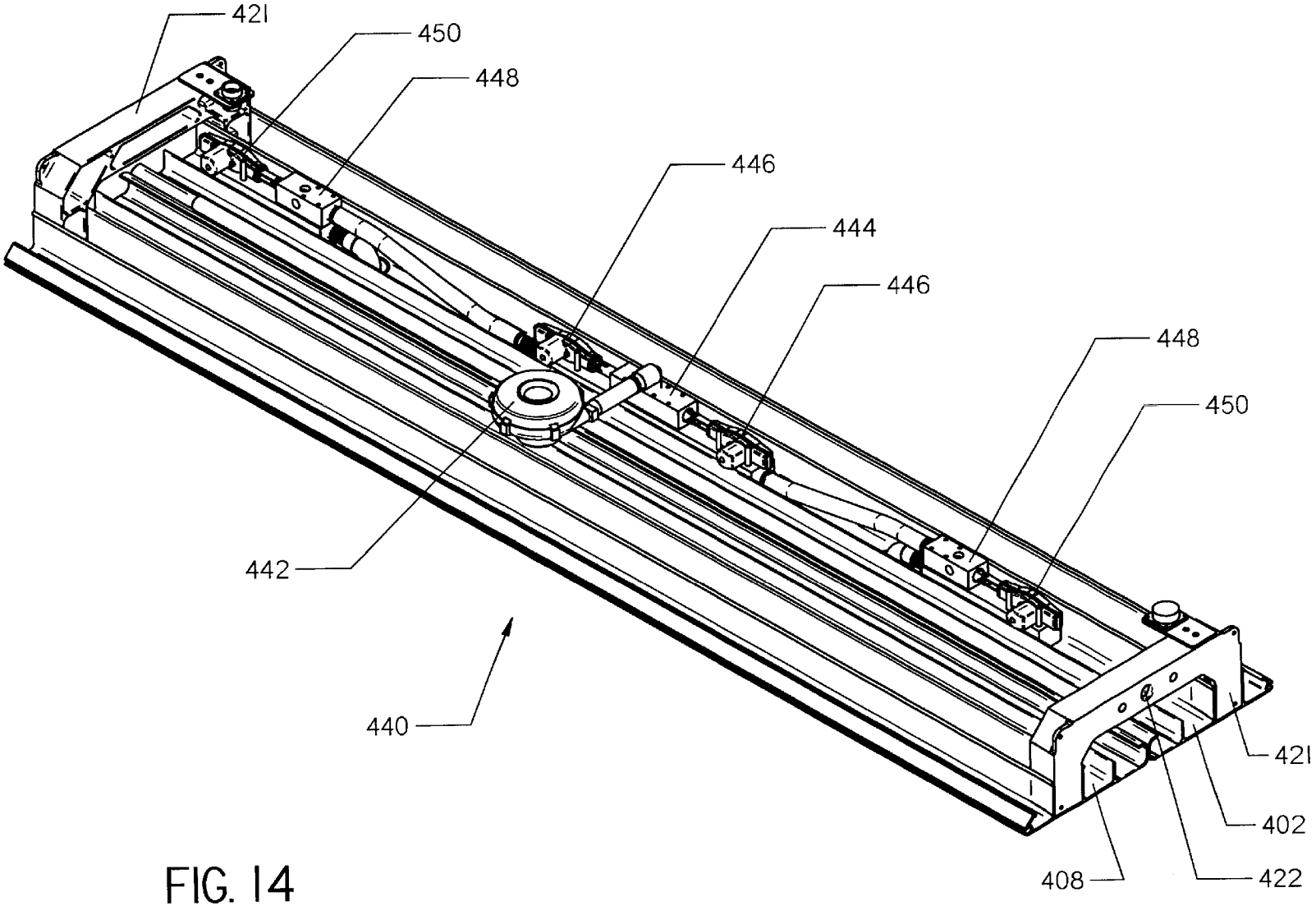
FIG. 14 is a perspective view of the pneumatic actuating subassembly.
Figure 15:
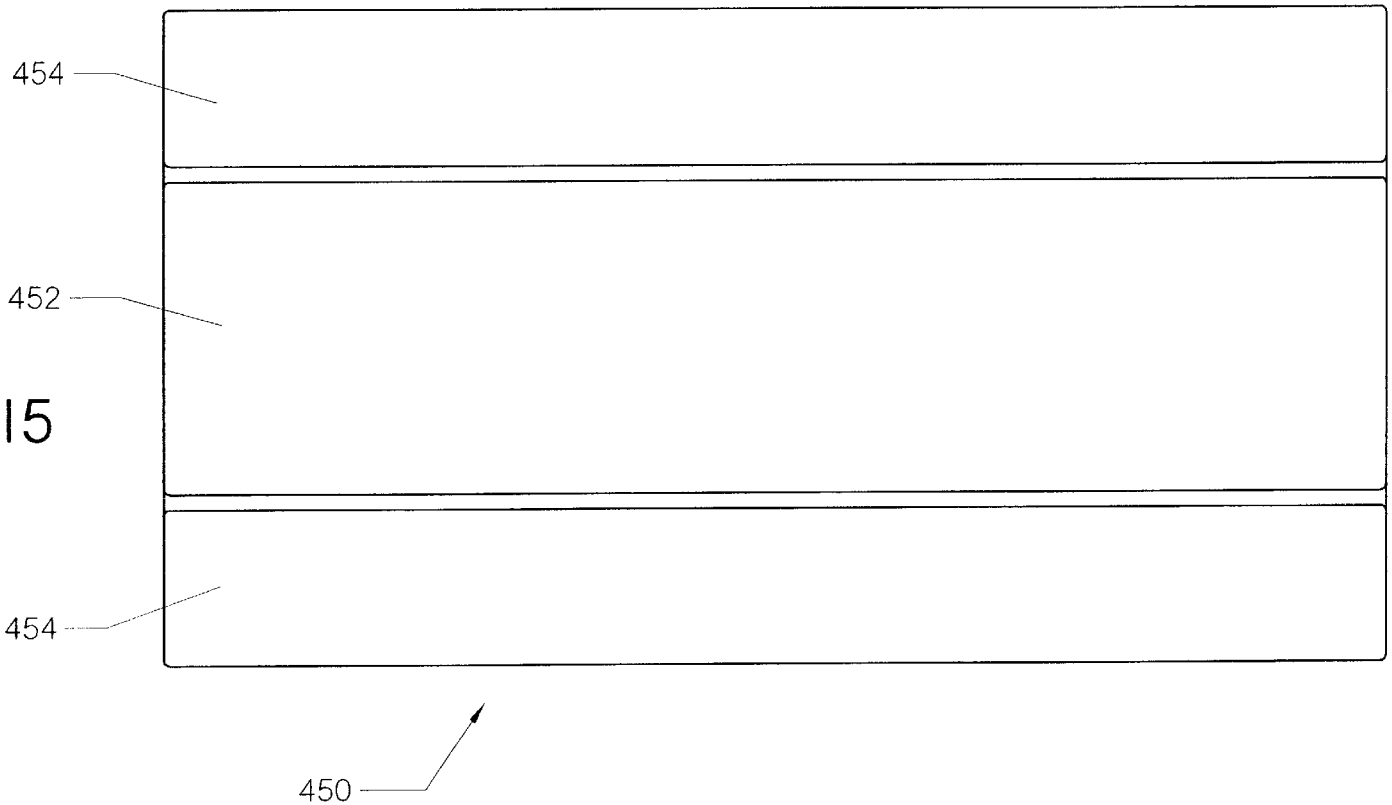
FIG. 15 is top view of the articulated mattress.
Figure 16:
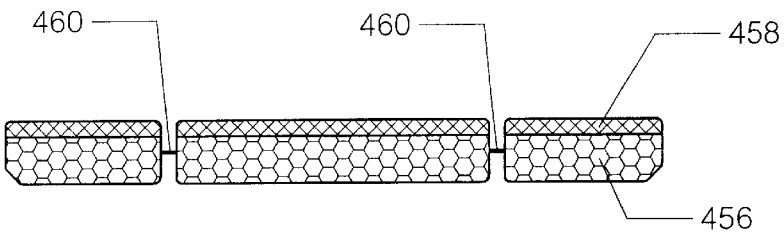
FIG. 16 is a side view of the articulated mattress.
Figure 17:
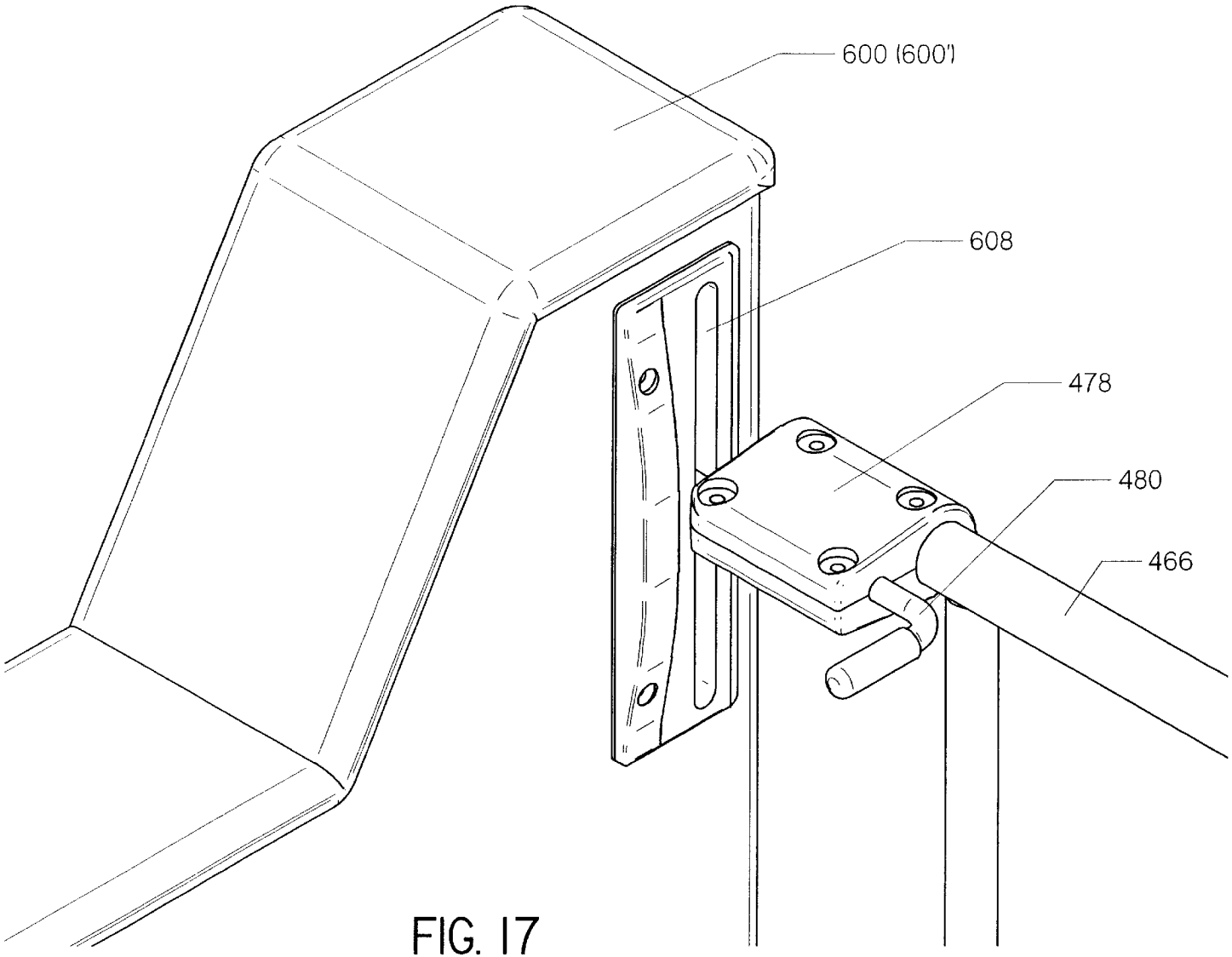
FIG. 17 is a perspective view of the latch pin block together with the headboard or footboard.
Figure 18:
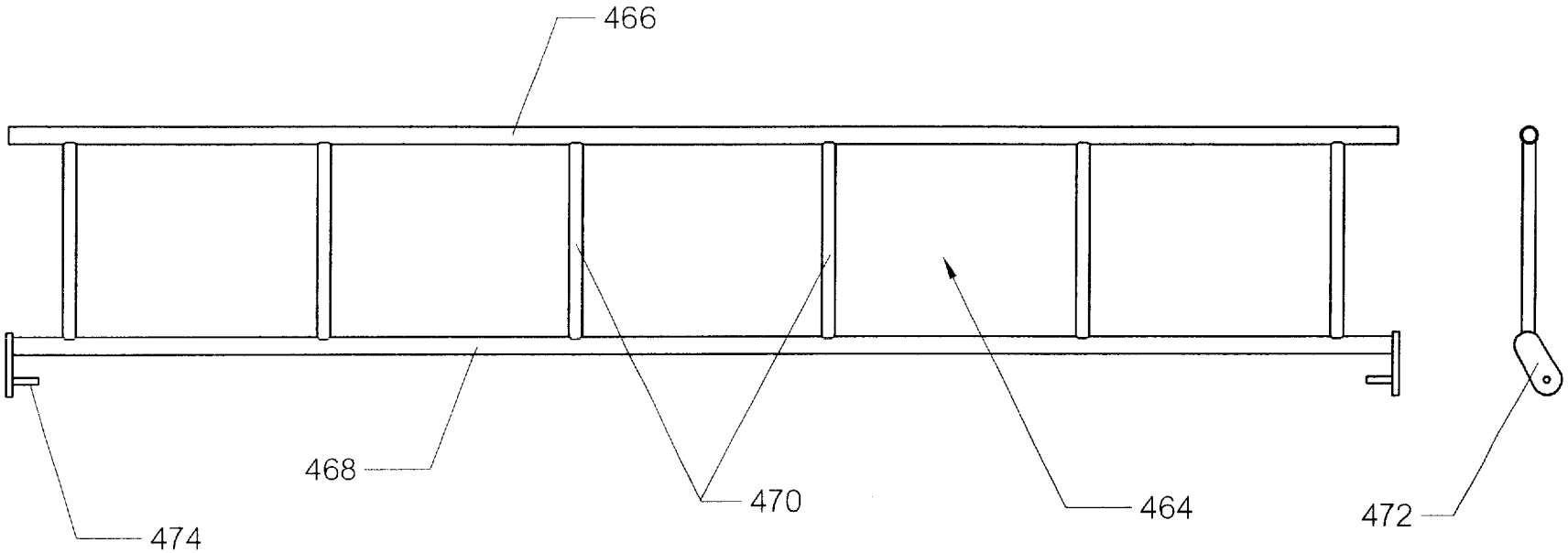
FIG. 18 is a front elevation view of a frame of a side rail assembly.
Figure 19:
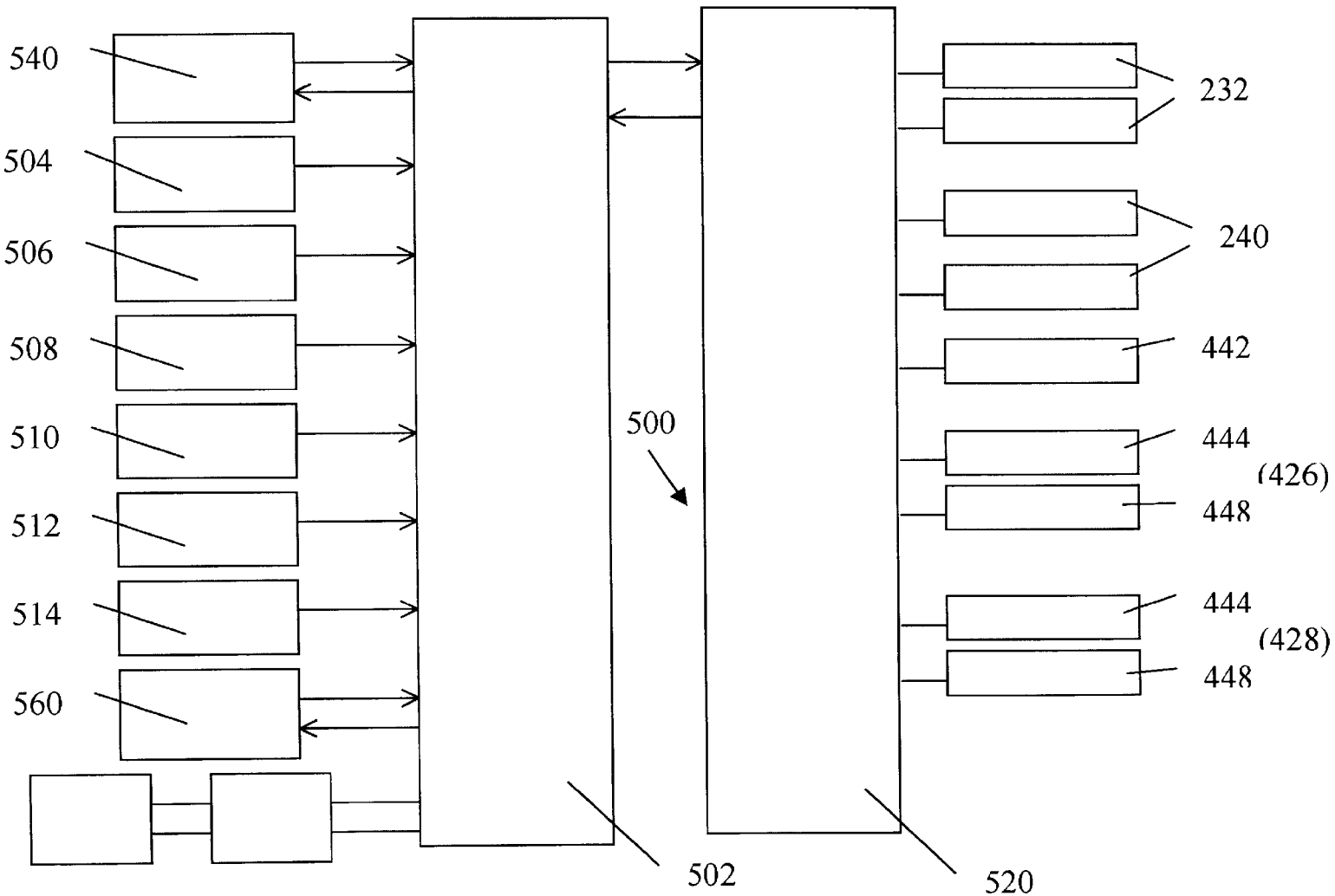
FIG. 19 is a schematic view of the command unit.

Briefly describing with reference to FIGS. 1 through 19, a bed with adjustable positions 100, according to the present invention, comprises a head unit 200, a foot unit 300 and a central unit 400. The latter is supported at one end by head unit 200, and at the other end by foot unit 300. A command unit 500 attached to bed 100 is used. A footboard 600 and a headboard 600' are used to incorporate head unit 200 and foot unit 300 respectively. Describing now in detail also with reference to the accompanying drawings, head unit 200 comprises an upper structure 202 located above a lower structure 204. Upper structure 202 comprises essentially a rectangular frame and is made of U-beams: an upper U-beam 206, a lower U-beam 208 and lateral U-beams 210 and 212, respectively.

Lower structure 204 has an elongated form, is made of a tubing 205 with a square cross section and is supported at each of its extremities by a caster 214.

A rod-guide step 216 is permanently secured to lower structure 204, beneath the middle of the latter, and extends laterally and outwardly.

An intermediary structure 218 is centrally and laterally positioned with respect to upper structure 202, to which it is rigidly secured, and includes an upper plate 220 and a lower plate 222. Upper plate 220 is secured to upper U-beam 206, while lower plate 222 to lower U-beam 208. Two guiding sleeves 224, each located symmetrically with respect to the longitudinal axis of symmetry of the bed, pass through upper and lower plates 220 and 222, to which they are rigidly aligned and attached. Lower plate 222 is also provided with a central hole 226 disposed between guiding sleeves 224.

A pair of guide rods 230 is attached to rod-guide step 216 and extends upwardly.

Each guide rod 230 has a close-running fit with its guiding sleeve 224. Thus, upper structure 202 can slide vertically.

A first electromechanical actuator 232 of linear type is used to elevate and lower upper structure 202. First electromechanical actuator 232 is provided with an actuation rod 234 and is vertically disposed, being attached to upper plate 220 and to rod guide step 216. First electromechanical actuator 232 of head means can operate simultaneously or independently with first electro-mechanical actuator 232 of foot means. Thus, said central unit can be lifted or inclined.

A rotation subassembly 236 comprises a rocker plate 238, to which is pivotally attached a second electromechanical actuator 240 of linear type. Rocker plate 238 is disposed and able to rotate in the interior of upper structure 202 and is provided with an upper aperture 242, an intermediary aperture 244 and a lower aperture 246.

A first bearing block 248, having a deep slotted guide 249 and coaxial central holes 250, is secured centrally to the interior of upper U-bearn 206. A pin 252 is inserted through coaxial central holes 250 and upper aperture 242.

The thickness of rocker plate 238 is commensurate with a close running fit, with deep slotted guide 249 of first bearing block 248. Thus, rocker plate 238, joined by pin 252 to first bearing block 248 can pivot when second electromechanical actuator 240 is activated.

A double-flanged adapter 254 having a passage hole 256, which coincides with lower aperture 246, is firmly attached to that side of rocker plate 238, which is directed toward central unit 400.

Second electro-mechanical actuator 240 has its body attached to upper structure 202, in an internal corner facing intermediary aperture 244.

An actuating rod 258 of second electromechanical actuator 240 has its external end pivotally attached, throughout intermediary aperture 244, to rocker plate 238.

A second bearing block 260 similar to first bearing block 248 is centrally secured to the upper surface of lower U-beam 208. Since the thickness of rocker plate 238 is commensurate with a close running fit with deep slotted guide 249 of second bearing block 260, rocker plate 238 can slide through second bearing block 206, when second electromechanical actuator 240 is activated.

A pair of inclination subassemblies 262, used during the rotation of the bed, is joined to the interior of upper structure 202. Each inclination subassembly 262 comprises a link 264, connected at its lower end, by overhanging pin 268, to a third bearing block 266. Third bearing block 266 is attached to the upper surface of lower U-beam 208.

An attachment bracket 267 is pivotally connected to an upper end of link 264. Due to the use of overhanging pin 268 which extends towards central unit 400, beyond both third bearing block 266 and upper structure 202, link 264 is able to be moved in a vertical plane which is parallel to and outside of both upper structure 202 and third bearing block 266.

Foot unit 300 has essentially the same structure as head unit 200, except several added components. These components will be described later as part of command unit 500.

Central unit 400 comprises a central platen 402, to which a pair of side platens 404 is hinged. Central platen 402 is of a rectangular shape with a pair of opposite, longitudinal margins 406 and a pair of opposite, transversal margins 408. Each opposite longitudinal margin 406 terminates in a large radius, longitudinally slotted cylinder 410.

Central platen 402 is usually made of extruded aluminum.

Each side platen 404 has a rectangular shape with long, exterior long and short margins 412, 413 and 414 respectively, and is hinged to central platen 402. To this end, one of long margins 412, adjacent to central platen 402, terminates in large radius, longitudinally slotted cylinder 410.

Side platens 404 are usually made of extruded aluminum.

A longitudinal insert 416 made of polymer comprises a web 418 flanked by small radius, slotted cylinders 420. Longitudinal insert 416 is adapted to be inserted with one small radius, slotted cylinder 420 in a large radius, slotted cylinder 410 of central platen 402 and with other small radius, slotted cylinder 420 in large radius, slotted cylinder 410 of a side platen 404.

A pair of mounting brackets 421 is attached to central platen 402. Each mounting bracket 421 has a centrally located passage opening 422 and is attached beneath central platen 402, flush to a transversal margin 408. Each mounting bracket 421 is joined to a corresponding double flange adapter 254, so that passage hole 256 of the latter coincides with passage opening 422 of mounting bracket 421. Thus, central platen 402 is connected to rotation rocker plate 238 of rotation subassembly 236.

Underneath, each side platen 404 is joined at both extremities, close to short margins 414, to an attachment bracket 267. The latter is connected to the upper end of link 264. Links 264 and attachment brackets 267 are components of inclination subassemblies 262.

Central unit 400 includes, as well, a pneumatic bag subassembly 424. The latter comprises upper and lower sections 426 and 428; each of these sections can be independently inflated or deflated.

Upper section 426 comprises three superposed bags 430 which are interconnected, so they can be inflated or deflated simultaneously. Upper and lower sections 426 and 428 are slightly narrower than the combined width of both central and side platens 402 and 404 respectively. Each of superposed bags 430 has its top edge directed toward the top of head unit 200, while its lower part is substantially supported on central and both side platens 402 and 404 respectively. Each of superposed bags 430 is provided with a flap 432 extending from its lower edge. Flaps 432 of all three superposed bags 430 are stacked and secured to central platen 402. Bag 430, which is in contact with central platen 402, is provided with a fitting 434 passing through the latter.

Lower section 428 comprises a single compartment bag 436, which is placed on central and both side platens 402 and 404 respectively, and extends from the lower edge of upper section 426 toward foot unit 300. Single compartment bag 436 is also provided with a fitting 434 passing through central platen 402.

Bags 430 and 436 are preferably made of medical grade nylon, coated with polyurethane for impermeability and hygiene.

A reaction board 438, having a width slightly narrower than central platen 402 and a length substantially equal to upper section 426, is placed on the latter and has an edge, which is close to the center of central platen 402, directly articulated to the latter by a hinge 439.

Central unit 400 includes as well a pneumatic actuating subassembly 440 firmly secured beneath central platen 402. Pneumatic actuating subassembly 440 includes an air blower 442 of brushless 12-volt type. Air blower 442 is connected to a feed valve 444. At each side of feed valve 444, there is a first valve actuator 446. One first valve actuator 446 opens the air supply to upper section 426, the other one—to lower section 428.

Use is made of a dump valve 448 for upper section 426, and another dump valve 448 for lower section 428. Each dump valve 448 is activated by a second valve actuator 450.

Fittings 434 are connected to corresponding feed and dump valves 444 and 448, respectively.

Central unit 400 includes as well an articulated mattress 450 which covers central and lateral platens 402 and 404, respectively.

Articulated mattress 450 comprises a central segment 452, to which two lateral segments 454 are longitudinally hinged. Central and lateral segments 452 and 454, respectively, are each formed of two superposed layers, a bottom layer 456 and a top layer 458, both layers being made of conventional mattresses foam. Bottom layer 456 is made of relatively high-density foam, while top layer 458—of relatively lower density foam. Central and lateral segments 452 and 454 are each enclosed in a zippered bag (not shown) made of medical grade nylon coated with polyurethane for impermeability and hygiene.

A longitudinal web 460, made of the same material as the zippered bags mentioned above, forms a hinge between two adjacent zippered bags. Each longitudinal web 460 is positioned basically, midway between upper and lower surfaces of articulated mattress 450.

The density of the foam used for articulated mattress 450 can be selected to comply with specific requirements of weight and comfort of the user. Alternatively to foam, other materials and/or combinations of materials, such as gels, air, etc., may be used.

Footboard 600 comprises an enclosure, for example made of wood, designed to incorporate foot unit 300. A receptacle 602 is located in a middle part 604 of footboard 600. A slot 608 is provided in each inside upper corners of footboard 600 and is directed toward the central unit 400.

Headboard 600' is similar to footboard 600, with the exception of receptacle 602.

Central unit 400 includes as well a pair of side rail assemblies 462. Each side rail assembly 462 is attached to an exterior long margin 413 of side platen 404. Each side rail assembly 462 comprises a frame 464 made of an upper and a lower tube 466 and 468 respectively and of several vertical tubes 470. The latter are firmly attached to upper and lower tubes 466 and 468. An arm 472 has one end attached to an extremity of lower tube 468 and another end to a pin 474. A bearing block 476 is mounted with a close running fit on pin 474 and is firmly attached to each exterior long margin 413 of side platens 404. A latch pin block 478 is firmly attached to each extremity of upper tubes 466. Latch pin block 478 has a spring-loaded pin 480, used as a guide for vertical movement in slot 608. By retracting spring-loaded pin 480 from slot 608,both side rail assemblies 462 are disconnected from footboard and headboard 600 and 600'.

Vertical movement of spring-loaded pin 480 in slot 608 is necessary to allow side rail assemblies to remain vertical and move while the bed is rotating.

Command unit 500 comprises the following:

a control board 502 located in foot unit 300;

a driver board 520 located in foot unit 300;

a control panel 540 located in footboard 600; and a user's key pad 560 connected by cable to control 502.

Control board 502 takes input from control panel 540 and user's keypad 560 in order to activate the multiple functions of the bed. The memory and decision making circuitry are located in control board 502. The latter also takes input from:

limit and center sensors for the roll function 504;

roll angle position sensors for the bed surface 506;

a trendelenberg angle sensor 508;

a head raiser angle sensor 510;

a large push button switch to allow the user to control the rotation of the bed in both manual and automatic modes 512;

side rails location sensors 514;

means for detecting end of travel current limit for the up/down and slant functions(not shown);

means for detecting over-current and over-temperature fault inputs from the driver module (not shown); and means for indicating voltage and current of the power system of the bed (not shown).

There is also provided a clock (not shown) in control board 502 that allows the latter to capture and retain information about any event of the bed.

Driver board 520 takes its commands from control board 502 via a bus (not shown) and activates the following units;

two first electromechanical actuators 232 used to elevate and lower upper structure 202;

two second electromechanical actuators 240 used to rotate central unit 400;

air blower 442;

valve actuators 446 and 450 which operate feed and dump valves 444 and 448 for upper and lower sections 426 and 428 respectively of pneumatic bag subassembly 424.

Driver board 520 also outputs information concerning over-current and over-temperature fault conditions throughout command unit 500.

User's keypad 560 allows input commands via an array of switches. These commands include: raise and lower bed, trendellenburg operations, head up and down, legs up and down, rotate right and left, auto/manual modes and level.

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as representative basis for teaching one skilled in the art to variously employ the present invention in virtually any appropriately detailed structure.

What is claimed is:

1. Bed with adjustable positions, comprising, in combination a head unit;

a foot unit; and a central unit supported at one end by said head unit and at the other end by said foot unit;

said head unit including a lower structure; and an upper structure;

means for vertically guided sliding of said upper structure with respect to said lower structure, said means for vertically guided sliding of said upper structure with respect to said lower structure being connected to said upper and lower structures;

first linear type actuating means for elevating or lowering said upper structure with respect to said lower structure, said first linear type actuating means being attached to said upper and lower structures;

means for rotating said central unit incorporating a rocker plate disposed and able to pivot in an interior of said upper structure; and second linear type actuating means for pivoting said rocker plate with respect to said upper structure;

a double-flanged adapter attached to a side of said rocker plate which is directed toward said central unit;

a pair of inclination subassemblies, used during rotation of said bed, comprising a link connected at its lower end to a lower beam of said upper structure by a pin which extends toward said central unit;

an attachment bracket connected to an upper end of said link; due to said pin which extends beyond said upper structure, said link can be moved in a vertical plane which is parallel and outside of said upper structure;

said foot unit having essentially the same structure as said head unit;

said central unit including a central platen to which a pair of side platens is hinged;

means for connecting transversal margins of said central platen to said rocker plate;

means for connecting short margins of each said side platens to said attachment brackets;

a pneumatic bag subassembly comprising an upper section and a lower section; each of said upper and lower sections being independently inflatable, said upper and lower sections being slightly narrower than a combined width of said central and side platens;

a reaction board disposed on said upper section and having a width slightly narrower than said central platen and a length substantially equal to said upper section, said reaction board having an edge hinged to a center of said central platen;

a pneumatic actuating subassembly secured beneath said central platen, said pneumatic actuating subassembly comprising an air blower connected to a feed valve connected at said air blower;

a first valve actuator connected at each end of said feed valve;

one of said first valve actuator opening an air supply to said upper section, another first valve actuator opening an air supply to said lower section;

a pair of dump valves; one dump valve for said upper section, another dump valve for said lower section of said pneumatic bag subassembly; and a pair of second valve actuators for said pair of dump valves;

an articulated mattress placed on said pneumatic bag subassembly, said articulated mattress including a central segment having a pair of longitudinal sides, to each of which is attached a lateral segment; and a pair of side rail assemblies, each of which being pivotally mounted to one of said exterior long margin of said side platen.

2. A pair of side rail assemblies, adaptable for use with a bed with adjustable positions, which bed comprises head, foot and central units, the latter being supported at one end by said head unit and at the other end by said foot unit; means for rotating said central unit; a pair of inclination subassemblies used during the rotation of the bed; a pneumatic bag subassembly disposed on a central and side platen of said central unit; a pneumatic actuating subassembly secured beneath said central platen; an articulated mattress placed on said pneumatic bag subassembly, wherein said pair of side rail subassemblies comprises a pair of frames, each of said frames being attached to an exterior long margin of said side platen.

3. A pair of side rail assemblies, adaptable for use with a bed with adjustable positions, as defined in claim 2, wherein each of said frames includes an upper tube;

a lower tube;

several vertical tubes firmly connecting said upper and lower tubes;

an arm having one end attached to an extremity of said lower tube and another end attached to a pin;

a bearing block mounted with a close running fit on said pin and firmly attached to an exterior long margin of said side platen; and a latch pin block comprising a spring loaded pin for vertical translation in a slot of a footboard or a headboard of said bed with adjustable positions.

4. A pneumatic bag subassembly, adaptable for use with a bed with adjustable positions, which bed comprises head, foot and central units, the latter being supported at one end by said head unit and at the other end by said foot unit; means for rotating said central unit; a pair of inclination subassemblies used during the rotation of the bed; a pneumatic actuating subassembly secured beneath a central platen of said central unit; an articulated mattress placed on said pneumatic bag subassembly; said pneumatic bag subassembly including upper and lower sections placed on a central and side platens of said central unit, said upper and lower sections being slightly narrower than a combined width of said central and side platens;

each of said sections being independently inflatable;

said upper section incorporating at least two superposed, interconnected bags;

said lower section comprising a single compartment bag;

said upper and lower sections being each provided with a fitting passing through said central platen; and a reaction board, having a width slightly narrower than said central platen and a length substantially equal to said upper section, being placed on said upper section and having an edge substantially close and hinged to a center of said central platen.

5. A head unit, adaptable for use with a bed with adjustable positions, which bed comprises head, foot and central units, the latter being supported at one end by said head unit and at the other end by said foot unit; means for rotating said central unit; a pair of inclination subassemblies used during the rotation of said bed; a pneumatic bag subassembly disposed on a central and side platen of said central unit; a pneumatic actuating subassembly secured beneath said central platen; an articulated mattress placed on said pneumatic bag subassembly, said head unit comprising a lower structure;

an upper structure located above said lower structure;

said upper structure incorporating essentially a rectangular frame;

said lower structure having an elongated form;

a rod-guide step fastened to said lower structure and extending laterally and outwardly;

an intermediary structure centrally and laterally positioned with respect to said upper structure, to which it is rigidly secured;

a pair of guiding sleeves attached to said upper and intermediary structures;

a pair of guide rods attached to said rod-guide step and extending upwardly;

linear type actuating means for elevating and lowering said upper structure, said actuating means for elevating and lowering said upper structure being interposed between said intermediary structure and said rod guide step, is used for sliding of said pair of guiding sleeves on said pair of guide rods.

* * * * *